US011815326B2

(12) United States Patent
Barnett

(10) Patent No.: US 11,815,326 B2
(45) Date of Patent: Nov. 14, 2023

(54) TAPERED MULTI-LAMINATED TUBULAR SLINGSHOT BAND

(71) Applicant: Barnett Outdoors, LLC, Tarpon Springs, FL (US)

(72) Inventor: David A. Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 17/731,960

(22) Filed: Apr. 28, 2022

(65) Prior Publication Data

US 2022/0349671 A1 Nov. 3, 2022

Related U.S. Application Data

(60) Provisional application No. 63/182,310, filed on Apr. 30, 2021.

(51) Int. Cl.

| | |
|---|---|
| ***F41B 3/02*** | (2006.01) |
| ***B05D 7/00*** | (2006.01) |
| ***B05D 1/18*** | (2006.01) |

(52) U.S. Cl.

CPC ..... *F41B 3/02* (2013.01); *B05D 1/18* (2013.01); *B05D 7/544* (2013.01)

(58) Field of Classification Search

CPC ..... F41B 3/02
USPC ..... 124/20.1
See application file for complete search history.

(56) References Cited

U.S. PATENT DOCUMENTS

| | | | | |
|---|---|---|---|---|
| 2,645,217 A * | 7/1953 | Fisher | F41B 3/02 | 124/20.3 |
| 2,995,129 A * | 8/1961 | Malott | F41B 3/02 | 124/20.1 |
| 3,018,770 A * | 1/1962 | Saunders | F41B 3/02 | 124/20.3 |
| 3,057,337 A * | 10/1962 | Rock | F41B 3/02 | 124/49 |
| 3,278,991 A * | 10/1966 | Peternell | B29C 41/14 | 118/425 |
| 3,511,221 A * | 5/1970 | Saunders | F41B 3/02 | 124/80 |
| 3,749,075 A * | 7/1973 | Saunders | F41B 3/02 | 273/DIG. 8 |

(Continued)

OTHER PUBLICATIONS

PCT International Searching Authority/US, International Search report and Written Opinion, dated Sep. 28, 2022, for PCT/US22/26780.

(Continued)

*Primary Examiner* — Alexander R Niconovich
(74) *Attorney, Agent, or Firm* — Jones Walker LLP

(57) ABSTRACT

An improved slingshot band having a tapered outer contour. The slingshot band has a tubular body having a first fork end and a second pouch end. The tubular body comprises a first layer of an elastic polymer. The first layer has a constant thickness. The tubular body further comprises a second layer of an elastic polymer. The second layer has a greater thickness near the fork end of the tubular body and lower thickness near the pouch end of the tubular body. The increased thickness of the section of the tubular body near the fork end of the slingshot band reinforces the most vulnerable section of the slingshot band against failure, thereby extending its longevity.

12 Claims, 2 Drawing Sheets

(56) References Cited

U.S. PATENT DOCUMENTS 3,923,034 A * 12/1975 Wolf ..... F41B 3/02 124/80
3,974,820 A * 8/1976 Ott ..... F41B 3/02 224/242
4,265,212 A * 5/1981 Wolf ..... F41B 3/02 124/20.1
4,373,503 A * 2/1983 Saunders ..... F41B 3/02 124/20.1
5,072,715 A * 12/1991 Barr ..... F41B 5/0026 124/17
5,501,207 A * 3/1996 Black ..... F41B 3/02 124/20.1
5,752,494 A * 5/1998 Tuller ..... F41B 3/02 124/20.3
5,803,067 A * 9/1998 Ellenburg ..... F41B 3/02 124/20.1
7,461,645 B2 * 12/2008 Williamson ..... F41J 9/18 124/20.1
7,484,505 B1 * 2/2009 Saunders ..... F41B 3/02 124/20.1
7,900,620 B1 * 3/2011 Walters ..... F41B 3/02 124/20.1
9,234,718 B2 * 1/2016 Ricke ..... A63B 65/00
10,816,302 B2 * 10/2020 Saunders ..... F41B 3/02
2008/0156307 A1 * 7/2008 Myers ..... F41B 3/02 124/20.1
2013/0192572 A1 * 8/2013 Shirk, II ..... F41B 3/02 124/20.1
2013/0333680 A1 * 12/2013 Canterbury ..... F41B 7/00 124/20.3
2016/0084609 A1 * 3/2016 James ..... F41B 3/02 124/20.1
2016/0153738 A1 * 6/2016 Cummings ..... F41B 5/0094 124/20.3

OTHER PUBLICATIONS

Marksman, Hyper Velocity Band Hunting Slingshot, 2015.

* cited by examiner

TAPERED MULTI-LAMINATED TUBULAR SLINGSHOT BAND

This application claims the benefit under 35 USC § 119(e) of U.S. Provisional Ser. No. 63/182,310 filed Apr. 30, 2021, which is incorporated by reference herein in its entirety.

BACKGROUND OF THE INVENTION

1. Field of the Invention

This invention relates to toy weapons. More specifically, it relates to a slingshot having a multi-laminated or multi-layered tapered tubular band.

2. Brief Description of the Related Art

Slingshots, sometimes also referred to as catapults, are classic children's toys. A typical slingshot comprises a handle, a fork disposed on top of the handle, and an elastic band attached to the fork. One design currently known in the art involves a two-part band, wherein a first end of each band is attached to the fork while the opposite end is attached to a pouch configured to hold a projectile. To operate the slingshot, a shooter holds the handle in front of the shooter, generally at an arm-length away from the shooter's torso. Using the free hand, the shooter places a projectile into the pouch, grasps the pouch with the projectile positioned therein, and pulls back the pouch relative to the handle, stretching the band. To shoot the projectile so positioned, the user takes aim and releases the pouch while continuing to hold the handle.

The band is a critical component of a slingshot. Over the years, slingshot bands have undergone several charges. In the past, a typical slingshot band would have a rectangular cross-section and would be made of extruded rubber. This design had several flaws, one of which was limited elasticity. Subsequently, the material of choice for a slingshot band has become latex, which offers much greater elasticity. Typically, latex slingshot bands are either flat or tubular and have a uniform cross-section, including a uniform inner and outer diameters and uniform wall thickness. This uniform design is generally dictated by the manufacturing process associated with extruding or rolling. However, this design has a major flaw—uniformly shaped slingshot bands tend to fail due to fatigue and exposure to ultraviolet radiation in the region proximal to the slingshot fork. The point of failure most commonly occurs near the fork because this section of the slingshot band undergoes the greatest elastic deformation and is also subjected to damage from ultraviolet radiation and impact of misfired projectiles.

Thus, what is needed is an improved slingshot band having increased longevity by being reinforced against failure in the region of the band proximal to the slingshot fork.

SUMMARY OF SELECTED EMBODIMENTS

One embodiment of the invention is a slingshot band assembly including two elastic bands with second ends connected to a slingshot pouch. Each of the elastic bands incudes (a) a first section with a first end configured for connection to a fork of a slingshot; (b) a third section connected to the slingshot pouch; (c) a second section between the first section and the third section; and (d) the first section having a first wall thickness greater than a second wall thickness of the third section.

Another embodiment is a slingshot band including a first section with a first end configured for connection to a fork of a slingshot and a third section opposite the first section. A second section is positioned between the first and third sections. The first section includes at least two layers of an elastic polymer and the third section includes a lesser number of layers of an elastic polymer material. An outer layer of elastic polymer on the first section tapers from a greater thickness proximate the fork to a lesser thickness more proximate to the third section.

DESCRIPTION OF THE DRAWINGS

For a fuller understanding of the invention, reference is made to the following detailed description, taken in connection with the accompanying drawings, in which.

DETAILED DESCRIPTION OF THE PREFERRED EMBODIMENT

In the following detailed description of certain preferred embodiments, reference is made to the accompanying drawings, which form part hereof, and within which specific embodiments are shown by way of illustration by which the invention may be practiced. It is to be understood that other embodiments may be utilized and structural changes may be made without departing from the scope of the invention.

Figure 1A:
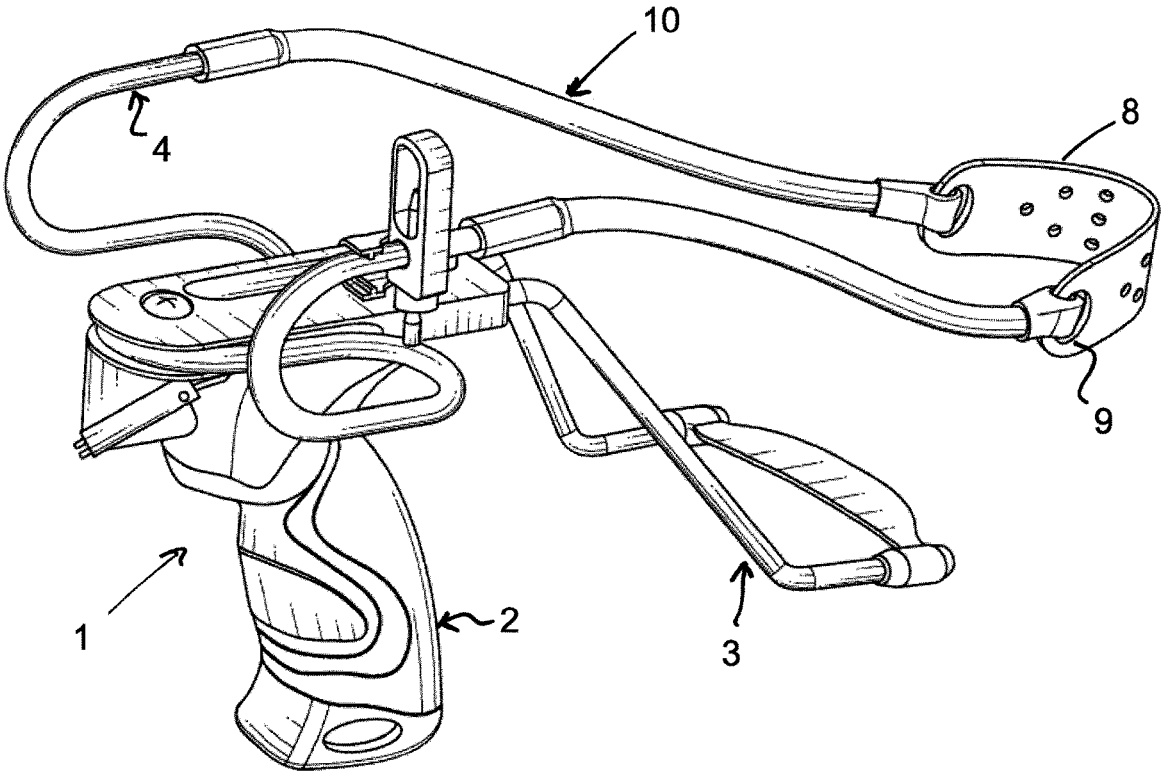
FIG. 1A depicts an isometric view of a slingshot with two bands connected to a pouch.

FIG. 1A depicts a conventional slingshot 1 including a handle 2, a wrist brace 3, and two arms or forks 4 extending from handle 2. Attached to each fork 4 is the novel slingshot band 10, with the band 10 terminating in its connection to slingshot pouch 8. The connection of band 10 to pouch 8 may be made in any conventional or future developed manner, for example by passing the end of band 10 though pouch eyelet 9 and knotting the band onto itself, or using a retaining ring to fix the folded portion (i.e., the portion passed through eyelet 9) of the band onto itself. In certain embodiments, the band 10 will have a length (in the band's relaxed state) of between 6 and 18 inches and could have a pull weight or draw weigh of between 5 and 30 lbs. (or any subrange in between).

Figure 1B:
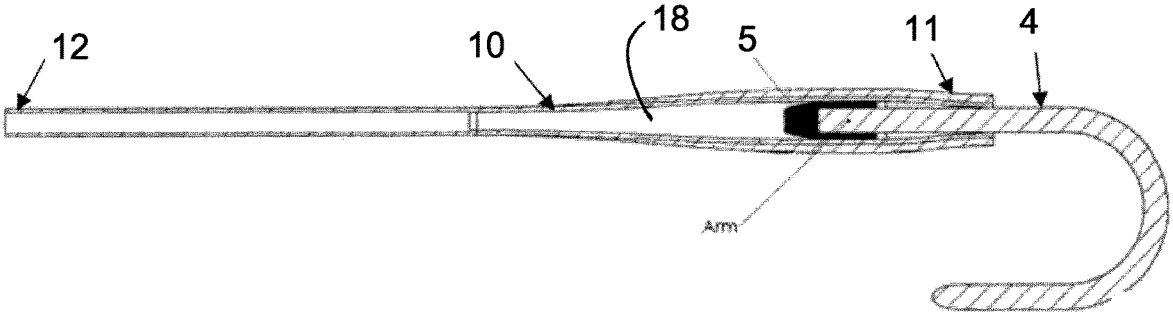
FIG. 1B depicts a side view of a slingshot band according to one embodiment of the invention.

FIG. 1B depicts a cross-sectional side view of the slingshot band 10 according to one embodiment of the invention. The slingshot band 10 can be manufactured from a latex material, or another elastic polymer. FIG. 1B depicts that the band 10 has a fork (or arm) end 11 and a pouch end 12. As seen in FIG. 1A, the fork end 11 of the slingshot band 10 is configured to be affixed to the fork (or arm) 4 of the slingshot, while the pouch end 12 is configured to be attached to the slingshot pouch 8.

In many embodiments, the slingshot band is tubular and has a hollow bore. FIG. 1B depicts that the fork end of the slingshot band may be configured for attachment to the fork 4, e.g., by providing the hollow bore 18 of the band which can be stretched over the end of fork 4. In some embodiments, the fork 4 will have a plastic fork cap 5 which protects the softer band material from the rigid material (e.g., steel) of the fork 4. Often the band is retained on fork cap 5 only by suction and interference fit.

Figure 2A:
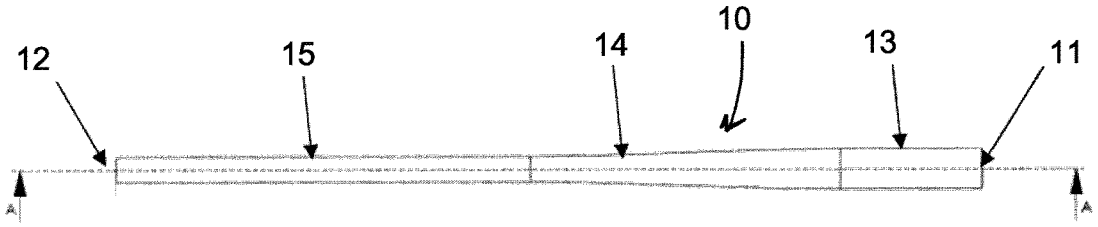
FIG. 2A depicts a side view of the exterior contour of the slingshot band according to a first embodiment of the invention.
Figure 2B:
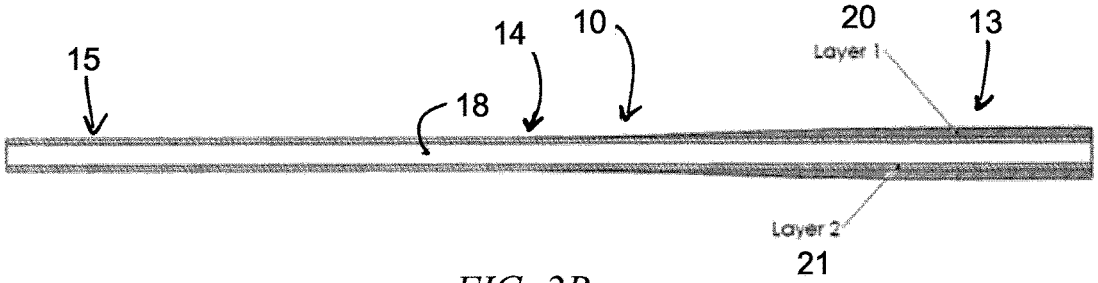
FIG. 2B depicts a cross-section side view of the exterior contour of the slingshot band according to the first embodiment of the invention.

FIGS. 2A and 2B depict a side view of one embodiment of the slingshot band 10. FIG. 2B depicts that, in this embodiment, the diameter of the bore 18 is constant along the entire length of the slingshot band. FIG. 2A depicts that the slingshot band 10 is subdivided into three sections: (1) the first section 13, which is proximal to the fork end 11; (2) the second section 14, which is the midsection of the band between the first section 13 and a third section 15; and (3) the third section 15, which is proximal to the pouch end 12 of the band.

FIG. 2B depicts a side cross-sectional view of the slingshot band. FIG. 2B depicts how the first section 13 has the greatest tubular wall thickness and the greatest outer diameter. FIG. 2B further depicts that the outer diameter and the wall thickness of the second section 14 of the slingshot band tapers from the interface of the midsection and the first section 13 toward the interface of the midsection and the second section 14. FIG. 2B also shows that the third section 15 of the slingshot band has a constant outer diameter and a constant tubular wall thickness. The wall thickness and, therefore, the outer diameter of the third section 15 is smaller than the outer diameter and the tubular wall thickness of the first section 13. This tapered tubular shape enables the slingshot band to achieve significant elastic deformation when pulled back by the user, while increasing resistance to wear and tear at the first section of the band, which is where slingshot bands usually fail.

FIG. 2B further depicts that the tapered tubular shape of this embodiment of the slingshot band is achieved by a multi-layer configuration. In FIG. 2B, the tubular wall thickness comprises a first layer 20 of an elastic polymer and a second layer 21 of an elastic polymer. The material used for both layers can be the same (e.g., latex)—or, alternatively, a different elastic polymer can be used for each layer. FIG. 2B further depicts that the thickness of the first layer 20 is the same throughout the length of the slingshot band. Additional layers of elastic polymer can also be included. In certain embodiments, the layer thickness can range anywhere between 0.020 inches and 0.20 inches, but thinner or thicker layers are possible.

FIG. 2B depicts that, to achieve the tapered shape that reinforces the strength of the slingshot band in the region near the fork end, the second layer 21 of an elastic polymer is deposited over the first layer 20 in the first section 13 and the second section 14 of the slingshot band. The second layer 21 has a uniform thickness in the first section 13 of the slingshot, and then the thickness of the second layer 21 tapers off in the midsection (or second section 14) of the slingshot band. The length over which the taper occurs can vary from embodiment to embodiment. The taper could occur over multiple inches in some embodiments, but in other embodiments, the taper may occur over only a fraction of an inch. The third section 15 of the slingshot band, which is proximal to the pouch end 12, does not have a second layer 21 of the elastic polymer. In this manner, the slingshot band has a cylindrical tubular body that is longitudinally tapered from the fork end of the band toward the pouch end of the band. Alternatively, the slingshot band may have a flat tubular body rather than a cylindrical tubular body. And while hollow bands are most commonly employed, other embodiments could have bands with solid cross-sections as long as the cross-section tapered in width (or thickness) along at least a portion of the band's length.

Figure 3A:
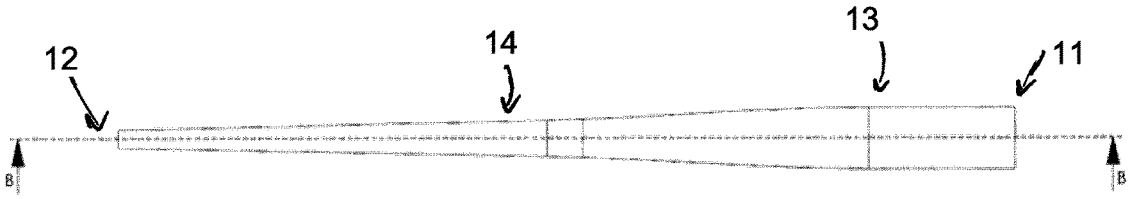
FIG. 3A depicts a side view of the exterior contour of the slingshot band according to a second embodiment of the invention.
Figure 3B:
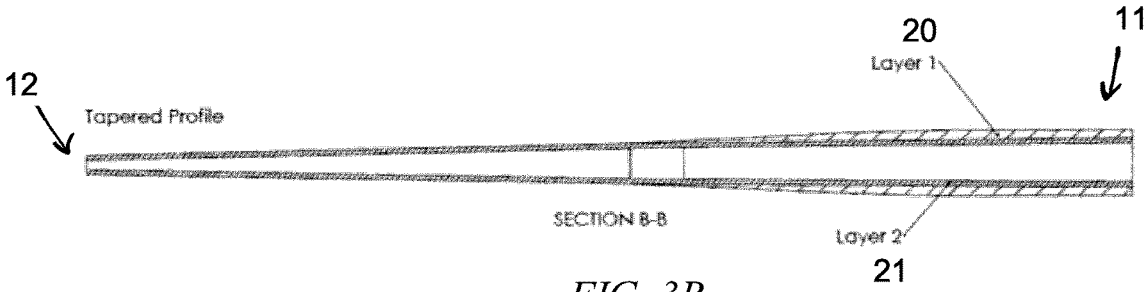
FIG. 3B depicts a cross-section side view of the exterior contour of the slingshot band according to the second embodiment of the invention.

FIGS. 3A and 3B depict an alternative embodiment of the tapered slingshot band. In this alternative embodiment, the inner diameter of the tubular slingshot band tapers from the fork end 11 toward the pouch end 12. Thus, the diameter of the hollow bore is not constant, as it is in the embodiment depicted in FIGS. 2A and 2B, but instead, gradually decreases from the fork 11 end toward the pouch end 12. In this embodiment the thickness of the first layer 20 is constant, while the thickness of the second layer 21, which is deposited over the first layer 20 in the first and second sections of the slingshot band, varies. Analogously to the embodiment of FIGS. 2A and 2B, the thickness of the second layer 21 in the first section 13 of the slingshot band, which is proximal to the fork end 11, is constant, while the thickness of the second layer 21 in the midsection of the band diminishes toward the pouch end 12 of the slingshot band.

Although the polymer layers could be formed by many conventional or future developed techniques, in one preferred embodiment, the layers are formed by a dip coating process. In one dip coating example, a mandrel having an OD approximately equal to the desired band ID (e.g. typically between ½" and ⅛") is dipped into a vat of a latex compound while in its wet form, i.e., while stabilized in its dispersion medium (e.g., water). The temperature of the mandrel, the composition of the latex compound, and the time the mandrel remains in the wet latex compound are some of the factors that will determine the thickness of the latex layer formed on the mandrel when it is removed from the vat of wet latex compound. In many embodiments, the first layer of latex is formed on the mandrel at a thickness of between 0.02 and 0.2 inches, with one preferred first layer thickness being about 0.06 inches. The first layer will have a length along the mandrel approximating or somewhat greater than the desired length of the band (e.g., for a band length between 6 and 18 inches). After at least partial curing of the first layer, the mandrel (still carrying the first layer) is dipped in the same or another vat of wet latex compound. However, the second layer is typically applied to the mandrel along a second length that is between 10% and 75% (or any subrange in between) of the length of the first layer, i.e., as seen in FIGS. 2 and 3, the second outer layer 21 does not extend the entire length of the band. In many embodiments, the second layer of latex is formed on the mandrel at a thickness of between 0.02 and 0.2 inches, with one preferred second layer thickness being about 0.03 inches. The second layer of latex will typically be of uniform thickness over most of its length, but there typically is a short transition or taper as the second layer terminates moving toward the pouch end of the band. In many embodiments, the dual layer bands will be subject to a vulcanization process to improve the mechanical characteristics of the latex rubber.

In certain embodiments, the band will be protected from environmental ultraviolet (UV) radiation by the application of a UV reflective coating. The UV reflective coating could be applied to the entire band, only the entire second layer, or to only a portion of the second layer proximate to the band's connection to the fork. A coating is considered "UV reflective" when it reflects at least 75% of the UV radiation it is exposed to, and more preferably between 75% and 95% of the UV radiation. Preferred coatings may be latex-based metallic colored (e.g., chrome or silver) coatings and will typically be applied prior to vulcanization. The preferred application process of such latex-based metallic coatings would likewise be a dipping process similar to that described above.

As an alternative to a separate UV reflective coating applied to the second layer, some embodiments of the band will modify the second layer to be more UV reflective. One modification to the second layer could be the addition of compounds to the latex which increase its rate of reflecting UV radiation. Another modification to second layer could be altering the color of the second layer such that the second layer reflects more UV radiation as compared to the first layer. For example, the second layer could be yellow or a lighter shade of green and would reflect more radiation than, for example, a black first layer of the band. As used herein, the term "color" includes black as an example of a relatively low UV reflecting hue and white as a high UV reflecting hue. In many embodiments, a second color is considered to have a higher UV reflection than a first color when the second color reflects at least 20% more UV than the first color. Thus, even somewhat dark shades of red or blue as a second layer may have a higher UV reflection than a first layer which is black.

The multi-layer tubular design of the slingshot band reinforces the region of the band that has the greatest potential for failure—the region near the fork end 11 of the band. This region undergoes the greatest elastic deformation and is also prone to being impacted by misfired slingshot projectiles. Furthermore, environmental factors—most significantly, UV radiation—may damage the slingshot band, reducing its ability to undergo elastic deformation without failure. By increasing the thickness of tubular wall in the region of the band subjected to the greatest elastic deformation, the present invention increases longevity of the band by reinforcing it in its most vulnerable region. At the same time, by providing a tapered design, the slingshot band does not present an excessive pull weight, enabling the users of all ages and strength levels to effectively fire the slingshot. As described above, the slingshot band can be coated, e.g., dipped—fully or partially in a reflective material layer to help shield the elastic polymer of the band from the harmful ultraviolet radiation (or the second layer of the band can have a less UV absorptive color).

The term "about" as used herein will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or possibly as much as +/−20%. Similarly, the term "substantially" will typically mean at least 85% to 99% of the characteristic modified by the term. For example, "substantially all" will mean at least 85%, at least 90%, or at least 95%, etc.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A slingshot band assembly including two elastic bands with second ends connected to a slingshot pouch, each of the elastic bands comprising:

a first section including a first end configured for connection to a fork of a slingshot;

a third section including the second end connected to the slingshot pouch;

a second section between the first section and the third section;

wherein the first section has a first wall thickness greater than a second wall thickness of the third section; and wherein the first section includes at least two laminated layers of an elastic polymer and the third section includes a lesser number of layers of an elastic polymer material.

2. The slingshot band assembly of claim 1, wherein an outer layer of elastic polymer on the first section tapers from a greater thickness proximate the fork to a lesser thickness more proximate to the third section.

3. The slingshot band assembly of claim 2, wherein an inner layer of substantially constant thickness extends from the fork to the pouch.

4. The slingshot band assembly of claim 1, wherein the elastic band is tubular, thereby defining an inner diameter.

5. The slingshot band assembly of claim 4, wherein the inner diameter is constant along a length of the band.

6. The slingshot band assembly of claim 4, wherein the inner diameter of the band decreases as the inner diameter progresses from the first section to the third section.

7. The slingshot band assembly of claim 1, wherein the first section configured for connection to the fork is tubular.

8. The slingshot band assembly of claim 1, wherein an ultraviolet resistant coating is applied to the band.

9. A slingshot band assembly including two elastic bands with second ends connected to a slingshot pouch, each of the elastic bands comprising:

(a) a hollow tubular body having a tubular wall encircling a hollow bore, the tubular body having a first end and the second end, the tubular body having a first section proximal to the first end, a third section proximal to the second end, and a second section between the first and the third sections, wherein the tubular wall comprises a first layer of a first elastic polymer, wherein the first layer has a constant first thickness throughout a length of the tubular body; and (b) a second layer of a second elastic polymer laminated over the first and the second sections of the tubular body, wherein a thickness of the second layer laminated over the second section of the tubular body has a second thickness that diminishes as the second section longitudinally progresses from a first interface with the first section toward a second interface with the third section, thereby creating a tapered outer contour of the hollow tubular body.

10. The slingshot band assembly of claim 9, wherein the first end is configured for connection to a fork of a slingshot.

11. The slingshot band assembly of claim 9, wherein an ultraviolet resistant coating is applied to the band.

12. The slingshot band assembly of claim 9, wherein the band has a length between 6 inches and 18 inches in a relaxed state.

* * * * *